United States Patent [19]

Voss et al.

[11] 3,951,762

[45] Apr. 20, 1976

[54] PREPARATION OF PERFLUORINATED ORGANIC SULFONYL FLUORIDES

[75] Inventors: Peter Voss, Leverkusen; Hans Niederprüm, Monheim, Rhineland; Manfred Wechsberg, Opladen, all of Germany

[73] Assignee: Bayer Aktiengesellschaft, Leverkusen, Germany

[22] Filed: Oct. 2, 1974

[21] Appl. No.: 511,560

Related U.S. Application Data

[63] Continuation of Ser. No. 322,268, Jan. 9, 1973.

[30] Foreign Application Priority Data

Jan. 14, 1972 Germany ..... 2201649

[52] U.S. Cl. ..... 204/59 F; 260/503

[51] Int. Cl.[2] ..... B01K 1/00; C07C 143/70; C25B 3/08

[58] Field of Search ..... 204/59 F; 260/503

[56] References Cited

UNITED STATES PATENTS

| | | | |
|---|---|---|---|
| 2,732,398 | 1/1956 | Brice et al. | 204/59 FX |
| 3,423,299 | 1/1969 | Loree | 204/59 F |
| 3,623,963 | 11/1971 | Voss et al. | 204/59 F |

*Primary Examiner*—F. C. Edmundson
*Attorney, Agent, or Firm*—Burgess, Dinklage & Sprung

[57] ABSTRACT

In the electrochemical fluorination of an alkanesulfonyl halide wherein an electric current is passed through a cell containing said alkanesulfonyl halide dissolved in hydrofluoric acid to produce a perfluorinated alkanesulfonyl fluoride, the improvement which comprises including in said cell an unsaturated cyclic sulfone.

6 Claims, No Drawings

PREPARATION OF PERFLUORINATED ORGANIC SULFONYL FLUORIDES

This is a continuation of application Ser. No. 322,268 filed Jan. 9, 1973.

This invention relates to an improved process for the electrochemical fluorination of organic compounds and in particular of long chain alkanesulfonyl halides.

As is well known, perfluorinated organic sulfonic acid derivatives, and particularly long chain perfluorinated alkyl derivatives, are of great technical importance and have a wide range of applications in the field of finishes for imparting oleophobic and hydrophobic properties to fiber materials such as textiles, leather and paper as well as in the field of surfactants. The high production costs due to the, as yet, incompletely resolved problems of electrofluorination have hitherto hindered the great interest in this class of substances and particularly in long chain perfluoroalkane-sulfonyl derivatives and specifically perfluoro-n-octane-sulfonyl fluoride. The high production costs have substantially prevented wider use of this industrially and technologically valuable class of substances.

As is well known, organic substances can be converted to perfluorinated compounds by electrolysis of a solution or suspension of a suitable organic substrate in substantially anhydrous liquid hydrogen fluoride, for example as described in U.S. Pat. No. 2,519,983, due to anodic substitution of hydrogen by fluorine. The process which was invented by J. H. Simons (Trans. Electrochem. Soc. 95, 47 (1948)) and has hitherto remained substantially unchanged had disadvantages and limits insofar as smooth fluorination by this process is generally only possible in the case of those substances which are soluble in liquid hydrogen fluoride and are therefore highly conductive. Only in the rarest cases are the yields of the perfluorinated product higher than 90% (as, for example, in the case of trifluoromethane-sulfonyl fluoride, which contains only one carbon atom), and if the process is applied to substances which contain more than one carbon atom per molecule then the yields rapidly decrease with increasing chain length. In the production of perfluorooctane-sulfonyl fluorides, for example, which are technologically particularly interesting, the highest yield which can be obtained is only 25% (U.S. Pat. No. 2,732,398; T. Gramstad and R. N. Haszeldine, J. Chem. Soc. 1640 (1957); British patent specification No. 1,099,240; Advances in Chemical research No. 21, "Organic Electrochemistry.", page 61 (1971)) while the remaining 75 to 80% of product, which is already partly fluorinated, is lost as a result of polymerization or condensation reactions, fluorination reactions leading to splitting of carbon-carbon bonds and other side reactions. Furthermore, these side reactions are the cause of rapid resinification of the electrodes, particularly since the resinous polymerization products are deposited on the anodes. Rapid fall in the conductivity of the electrolyte, poor material and current yields, low volume/time yields, the need for frequent cleaning of the electrodes which get clogged with sludge and the need for frequent replacement of the electrolyte solution are undesirable phenomena accompanying the methods previously employed.

In U.S. Pat. No. 3,028,321 there is described a process for the electrofluorination of benzenesulfonyl halides in which additives are introduced to the electrolytes to prevent resinification of the electrodes. These additives belong to the class of substances comprising mercaptans, sulfides and disulfides. These substances, however, do not result in a marked improvement in the process; on the contrary, mercaptans are said to be quite unstable in anhydrous hydrofluoric acid and their presence leads to the formation of resinous products (J. H. Simons, Fluorine Chemistry, Volume I, 238–239 (1950)).

It is accordingly an object of the present invention to effect an electrochemical fluorination of an alkanesulfonyl halide which process can be effected simply, in relatively high yield and substantially continuously.

These and other objects and advantages are realized in accordance with the present invention which relates to a process for the electrochemical fluorination of organic compounds, in particular of long chain alkanesulfonyl derivatives, in practically anhydrous hydrofluoric acid, which process is characterized in that the electrochemical fluorination is carried out in the presence of an unsaturated cyclic sulfone.

The sulfones used, which have the formula:

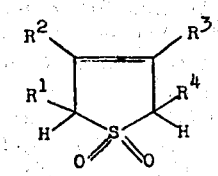

in which $R^1$, $R^2$, $R^3$ and $R^4$ each independently is hydrogen or lower alkyl, preferably of 1 to 5 carbon atoms, are very readily soluble in anhydrous hydrofluoric acid and manifest several empirically discovered effects which promote the formation of the desired perfluorinated compounds in preference to by-products.

The organic compounds used as original substrate according to the invention may be alkanesulfonyl halides of any structure. In addition to n-octane-sulfonyl fluoride, n-octane-sulfonyl chloride is also particularly suitable as are n-decane-sulfonyl fluoride and n-hexane-sulfonyl fluoride as well as the corresonding branched derivatives such as the isomeric octane-sulfonyl halides.

The process according to the invention overcomes some of the difficulties which arise in conventional processes especially in the production of long chain perfluoroalkyl derivatives and in addition this electrochemical method of introducing fluorine into organic compounds is rendered much more economical. Thus, for example with the process according to the invention it is possible to increase the product yields by 70 to 100% compared with the yields given in the literature.

In the case of n-octane-sulfonyl fluoride, the yields obtained by the process according to the invention may be more than twice as high as those obtained under otherwise comparable operating conditions but without the addition of sulfolenes (2,5-dihydro-thiophene-S-dioxides). Moreover, the conductivity of the electrolyte, which in the previous processes is satisfactory only at the beginning of the fluorination reaction, can be preserved substantially unchanged over several months of uninterrupted electrolysis by continuously supplying the sulfolene additive, with the result that the volume/time yields are improved. Furthermore, addition of the sulfolene reduces the deposition of polymeric by-products on the electrodes, a particular advantage being that the small amount of deposit which still occurs is not in the form of a sticky coating but in the form of a substantially spongy precipitate so that the anodic substitution reaction is hardly interfered with even if the run is continued for a long time. Moreover, after completion of a run of long duration, the electrodes can be cleaned with solvents alone without any mechanical effort. In contrast to inorganic additives used for increasing the conductivity, sulfolenes cause no undesirable corrosion of the electrodes of the kind observed, for example, when adding alkali metal fluorides.

The optimum quantities to be used of the additive according to the invention should be determined empirically in each case according to the operating conditions selected. Proportions by weight of organic substrate to additive of about 5 to 1 have been found to be the most suitable although other proportions by weight are also suitable, e.g. about 0.25–100 to 1, in particular about 2–5 to 1. The preferred additive is butadiene sulfone (common name "Sulfolene") because it is so readily available being an addition product of sulfur dioxide and butadiene, but other alkyl-substituted sulfolenes may also be used, for example 3-methyl-sulfolene which may be obtained from isoprene and sulfur dioxide, or 1,4-methyl-sulfolene (from dimethylbutadiene + sulfur dioxide).

Other compounds suitable for use as additives have been described e.g. in S. D. Turk and R. L. Cobb, "Organic Chemistry, A series of Monographs", Vol. 8, Academic Press, New York 1967, Chapter 2, including the addition products of $SO_2$ and 2-methyl-1,3-butadiene or 2,3-dimethyl-1,3-butadiene or 2-tert.-butyl-1,3-butadiene, to name a few.

As earlier experiments have shown (see e.g. German Offenlegungsschrift No. 1,912,738), sulfolenes are readily fluorinated by electrolysis with formation of the corresponding perfluorinated aliphatic sulfonyl fluorides. The resulting perfluoroalkane-sulfonyl fluorides are valuable intermediate products for other products with numerous possibilities of technical application which can be economically utilized. Thus, for example perfluoroalkane-sulfonic acids ($R_F SO_3H$, $R_F$ = perfluoroalkyl) obtained by hydrolysis of these sulfonyl fluorides are among the strongest known protonic acids and are efficient catalysts, for example for polymerization reactions or isomerization reactions. The perfluorinated sulfonyl fluorides obtained by the process of this invention by fluorination of the sulfolene additives can easily be separated by distillation from the other fluorination products and are, therefore, valuable byproducts. However, the mixtures of crude products need not necessarily be separated but, according to another proposal, can be worked up directly, e.g. for the production of surface-active agents.

The electrolytic cells used for electrofluorination are preferably made of nickel or some other non-corrosive material. The electrode packet consists of nickel anodes and nickel or iron cathodes arranged alternately 2 to 3 mm apart. The voltage at the terminals is between about 4.5 and 8 volts and the current density is about 0.5 Amps/dm². The temperature of the electrolyte during electrolysis usually does not rise above about 12°C and is on average about 6° to 8°C. Other cell arrangements as well as specific details relating to the construction and operating conditions of the electrolytic cells suitable for the process according to the invention may be found in the literature quoted above.

In the following Examples, the starting material used for the preparation of perfluorooctane-sulfonyl fluoride was n-octane-sulfonyl fluoride. This is readily soluble in anhydrous hydrofluoric acid and was used at an initial concentration of 10% by weight, based on hydrofluoric acid. The additive used was in all cases commercially obtainable butadiene sulfone. Experiments were carried out under otherwise comparable operating conditions; the results entered in the table for experiment 1 were obtained when using figures given in the literature without using the process according to this invention.

Two Examples are given to explain the process of this invention more fully, the results being summarized in the table.

EXAMPLE 1

27.5 liters of anhydrous hydrofluoric acid, 2.75 kg (14 moles) of n-octane-sulfonyl fluoride and 0.55 kg (4.66 moles) of butadiene sulfone were introduced successively into an electrolytic cell which had a capacity of 35 liters when ready for operation and a theoretical anode surface of 12,390 cm². By daily addition of the quantities of $C_8H_{17}SO_2F$ and the sulfone additive required for good conductivity, the total amount used up to the end of the experiment was 11.9 kg (60.7 moles) of n-octane-sulfonyl fluoride and 2.38 kg (18.2 moles) of butadiene sulfone. The average current was 49.2 Amps, which corresponds to a theoretical average current density of 3.97 milliAmps/cm². The voltage measured at the terminals was about 6 volts at the beginning of electrolysis and after the addition of crude starting material and additive but did not exceed 8 volts even when the conductivity of the bath was low. The average temperature of the bath was about 9°C.

Electrolysis was terminated after a period of time of 1033.4 hours and a current consumption of 50,796 Ampere hours. By the end of that time, 17.0 kg of perfluorinated crude product had been formed, which separated as a water-clear, heavy phase at the bottom of the cell and was continuously discharged.

The crude product was washed with an aqueous triethylamine solution and water to remove traces of residual hydrofluoric acid and was then distilled.

The yield of perfluorooctane-sulfonyl fluoride was 10.5 kg, which is 34.5 mole % of the theoretical yield.

EXAMPLE 2

The electrolytic cell used which had a theoretical effective anode current density of 5 milliAmps per cm² allows for the circulation of electrolyte at the rate of about 250 liters/h.

The electrolytic cell was charged successively with 40 liters of anhydrous hydrofluoric acid, 3.5 kg (17.9 moles) of n-octane-sulphonyl fluoride and 0.75 kg (6.35 moles) of butadiene sulfone and electrolyzed at an initial voltage between the terminals of 5.5 volts and a current consumption of 100 Amps. Further addition of the $C_8H_{17}SO_2F$ and the sulfone additive in quantities of about 1 kg and 0.2 kg, respectively, was carried out whenever the current consumption of the cell dropped to about 30 Amps. Towards the end of the experiment, only the sulfone was added until the amount of perfluorooctane-sulfonyl fluoride in the crude product drawn off was less than 40% by weight. In this way, 14.8 kg (75.5 moles) of $C_8H_{17}SO_2F$ and 8.7 kg (73.8 moles) of butadiene sulfone were used up over 1600 hours of electrolysis. The resulting perfluorinated crude product had an average perfluorooctane sulfonyl fluoride content, determined by gas chromatography, of 56.4% by weight, which for 25.9 kg of crude product corresponds to a yield of 14.6 kg of $C_8F_{17}SO_2F$ i.e. 38.5 mole percent of the theoretical yield based on the amount of n-octane-sulfonyl fluoride used.

| | Experiment 1 | Example 1 | Example 2 |
|---|---|---|---|
| Starting material | | | |
| n-$C_8H_{17}SO_2F$ (kg) | 7.9 | 11.9 | 14.8 |
| Proportion by weight | | | |
| Substrate : Additive | 1 : 0 | 5 : 1 | 1.7 : 1 |
| Electrolysis time (hours) | 1386 | 1033 | 1600 |
| Ampere hours consumed (Ah) | 62776 | 50796 | 90830 |
| Current yield (g $C_8F_{17}SO_2F$/1000 Ah) | 49.4 | 206 | 161 |
| Material yield of $C_8F_{17}SO_2F$ (kg) | 3.1 | 10.5 | 14.6 |
| (% of the theoretical) based on $C_8H_{17}SO_2F$ | 15.3 | 34.5 | 38.5 |
| Time yield (g of $C_8F_{17}SO_2F$ per hour of electrolysis) | 2.24 | 10.2 | 9.14 |
| Material yield of $C_4F_9SO_2F$ (kg) | 0 | 3.10 | 6.55 |
| based on additive (% of the theoretical) | 0 | 50.9 | 29.4 |

It will be appreciated that the instant specification and examples are set forth by way of illustration and not limitation, and that various modifications and changes may be made without departing from the spirit and scope of the present invention.

What is claimed is:

1. In the electrochemical fluorination of an alkanesulfonyl halide wherein an electric current is passed through a cell containing said alkanesulfonyl halide dissolved in hydrofluoric acid to produce a perfluorinated alkanesulfonyl fluoride, the improvement which comprises including in said cell about 1 to 400%, based on the weight of the alkanesulfonyl halide, of an unsaturated cyclic sulfone of the formula

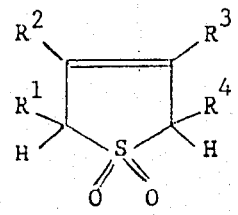

in which $R^1$, $R^2$, $R^3$ and $R^4$ each independently is hydrogen or lower alkyl.

2. The process of claim 1, wherein the hydrofluoric acid is substantially anhydrous, the alkanesulfonyl halide has about 6 to 10 carbon atoms, the sulfone is present in about 20 to 50% by weight of the alkanesulfonyl halide, product being withdrawn from said cell and make-up alkane-sulfonyl halide and sulfone being added thereto to effect the reaction continuously.

3. The process of claim 2, wherein the sulfone is butadiene sulfone.

4. The process of claim 3, wherein the sulfone is methyl-butadiene sulfone.

5. In the electrochemical fluorination of an alkanesulfonyl halide having about 6 to 10 carbon atoms wherein an electric current is passed through a cell containing said alkanesulfonyl halide dissolved in hydrofluoric acid to produce a perfluorinated alkanesulfonyl fluoride, the improvement which comprises including in said cell butadiene sulfone in about 1 to 400% by weight of the alkanesulfonyl halide.

6. The process of claim 5, wherein the hydrofluoric acid is substantially anhydrous, the sulfone is present in about 20 to 50% by weight of the alkanesulfonyl halide, product being withdrawn from said cell and make-up alkanesulfonyl halide and sulfone being added thereto to effect the reaction continuously.

* * * * *